US007462768B2

(12) United States Patent
Newmaster

(10) Patent No.: US 7,462,768 B2
(45) Date of Patent: Dec. 9, 2008

(54) GUITAR PICK

(76) Inventor: Josiah T. Newmaster, 2525 Aiden Dr., Evansville, IN (US) 47701

( * ) Notice: Subject to any disclaimer, the term of this patent is extended or adjusted under 35 U.S.C. 154(b) by 413 days.

(21) Appl. No.: 11/410,390

(22) Filed: Apr. 25, 2006

(65) Prior Publication Data

US 2007/0256533 A1 Nov. 8, 2007

(51) Int. Cl.
*G10D 3/16* (2006.01)

(52) U.S. Cl. ..... 84/322; 84/320

(58) Field of Classification Search ..... 84/322, 84/320, 321; D17/20
See application file for complete search history.

(56) References Cited

U.S. PATENT DOCUMENTS 2,459,274 A * 1/1949 Galetzky ..... 84/320
2,484,820 A * 10/1949 Galetzky ..... 84/322
D395,330 S * 6/1998 Sarno ..... D17/20
D490,459 S * 5/2004 Sarmas ..... D17/20
2003/0106410 A1* 6/2003 Hautamaki et al. ..... 84/322

* cited by examiner

*Primary Examiner*—Walter Benson
*Assistant Examiner*—Jianchun Qin
(74) *Attorney, Agent, or Firm*—Gary K. Price, Esq.

(57) ABSTRACT

An improved guitar pick or plectrum for use with a stringed musical instrument. The improved pick has a substantially planar central gripping portion and at least one and not more than four substantially planar picking wing portions peripherally extending, one each in a respective different longitudinal direction from the central gripping portion. In application, only one of the wing portions may be used at any one time. The wing portions can include an end surface having a different jagged or serrated picking edge formed of at least two and not more than four peak members adapted for strumming or plucking the strings of a stringed instrument so that each of the peak members strike the string in rapid sequence.

4 Claims, 3 Drawing Sheets

GUITAR PICK

CROSS REFERENCES TO RELATED APPLICATIONS

None.

STATEMENT AS TO RIGHTS TO INVENTIONS MADE UNDER FEDERALLY SPONSORED RESEARCH AND DEVELOPMENT

Not Applicable.

BACKGROUND OF THE INVENTION

1. Field of the Invention

This invention relates generally to a guitar pick or a plectrum for use with a stringed musical instrument, and more particularly, to an improved plectrum for use with a stringed musical instrument.

2. Brief Description of Prior Art

In playing a guitar, or other stringed musical instrument, a musician will typically use a pick or plectrum to pluck one or more strings of the instrument, thus effecting vibration in the strings of the instrument thereby generating sounds and tones. Typically, these picks are all similarly constructed from a resilient material, such as plastic, to be flat and substantially triangular-shaped. In use, the traditional pick is gripped between the thumb and forefinger and directed across the strings or strings of choice.

The musician is frequently called upon to produce a number of different tones in a single performance. It is not uncommon for today's performing musician to need to produce three or more different tones within a span of the performance. In the past, when musicians needed to produce these different tones in their respective performance, they would commonly equip themselves with a number of different picks, each being of a different single thickness and material of construction, as appropriate. Carrying a number of picks is a cumbersome task, and when the musician is further required to keep track of where he has placed a number of different types of picks, either on his person or on a dimly lit stage, the significant possibility exists that a particularly desired pick might be misplaced or misidentified at the very moment that it is required.

Accordingly, it is desirable to design a single pick that is used by the musician that is gripped and played like the traditional pick known, and can produce a number of different relative tones.

As will be seen from the subsequent description, the preferred embodiments of the present invention overcome disadvantages of the prior art.

SUMMARY OF THE INVENTION

In accordance with the present invention, an improved guitar pick or plectrum is provided for use with a stringed musical instrument. The improved pick has a substantially planar central gripping portion and at least one and not more than four substantially planar picking wing portions peripherally extending, one each in a respective different longitudinal direction from the central gripping portion. In application, only one of the wing portions may be used at any one time. Each of the wing portions include an end surface having a different jagged or serrated picking edge, so as to produce a different relative tone or unique sound when each is respectively used.

DESCRIPTION OF THE PREFERRED EMBODIMENT

Figure 1:
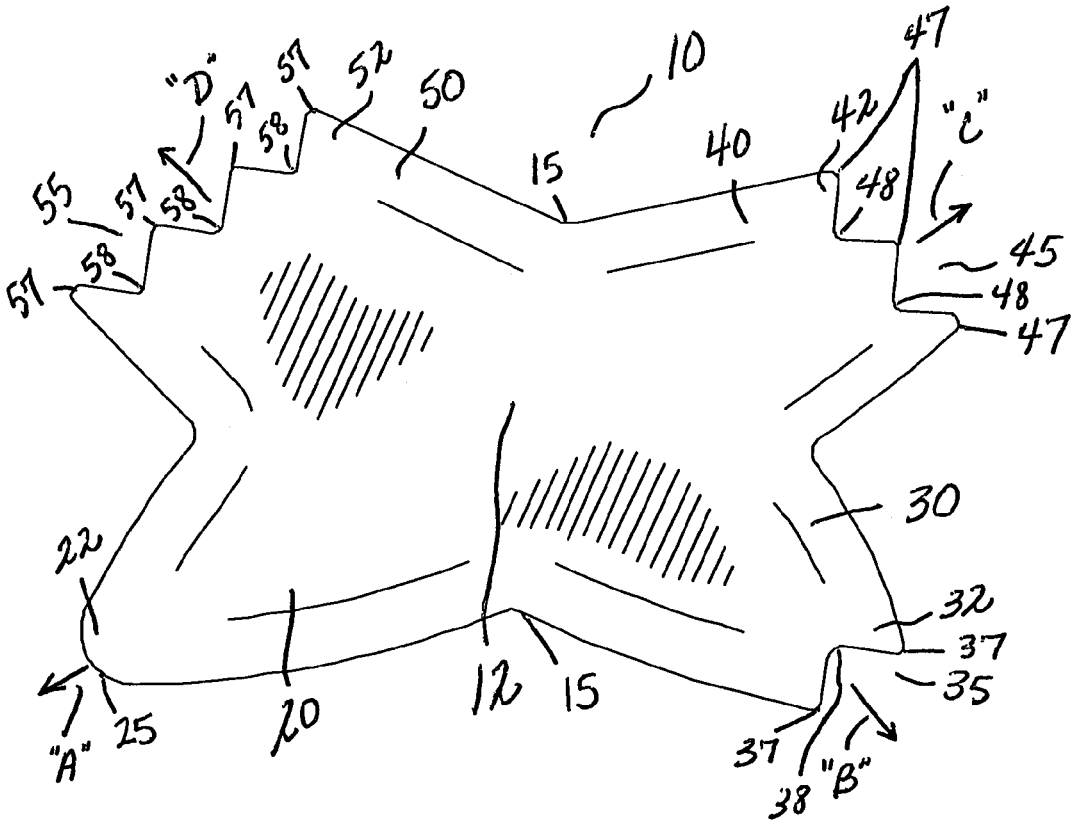
FIG. 1 is a top front view of an improved guitar pick for use with a stringed musical instrument according to the present invention.
Figure 2:
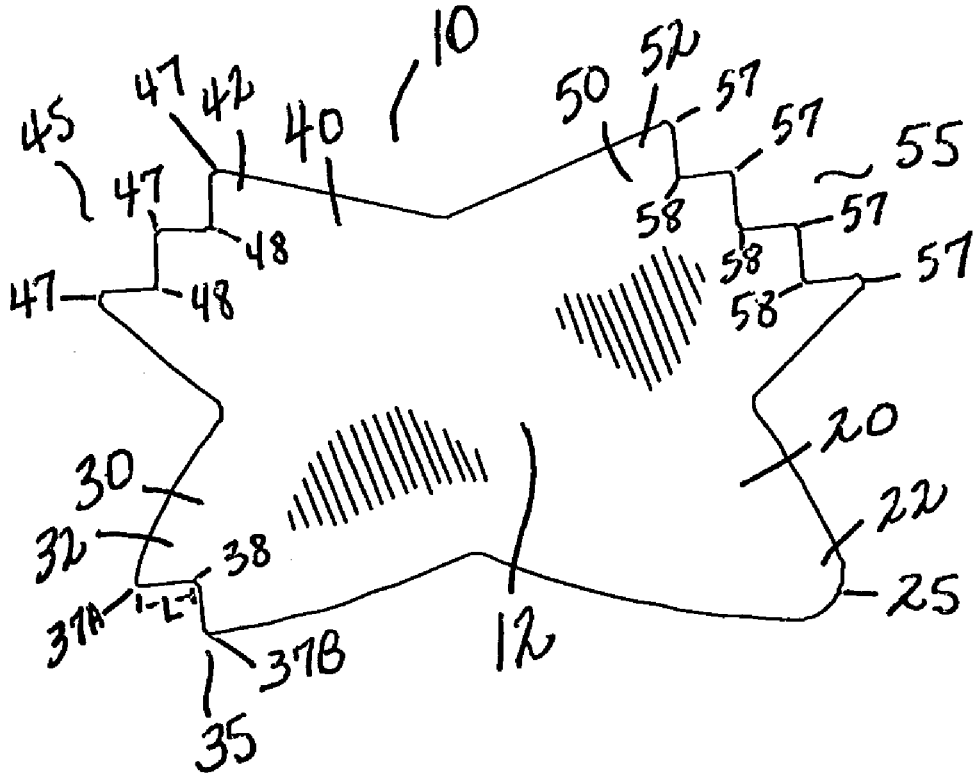
FIG. 2 is a top rear view of the improved guitar pick of FIG. 1.

In accordance with the present invention, an improved guitar pick for use with a stringed musical instrument is enclosed. Referring to FIGS. 1 and 2 of the drawings, there is shown a preferred embodiment of the improved guitar pick 10 for use with a stringed musical instrument (not shown). The improved guitar pick 10 has a substantially planar central gripping portion 12 having a periphery 15 and four substantially planar picking wing portions 20, 30, 40 and 50. As illustrated in FIG. 1, each of the wing portions 20, 30, 40 and 50 peripherally extending one each in a respective different longitudinal direction as indicated respectively by arrows "A", "B", "C" and "D" from the central gripping portion 12. As illustrated, each wing portion includes an end portion 22, 32, 42 and 52 respectively. In the preferred embodiment, each respective different longitudinal direction "A", "B", "C" and "D" is equally spaced, relative to each adjacent respective different longitudinal direction about the central gripping portion 12.

As stated, the four wing portions 20, 30, 40 and 50 comprise a first wing portion 20 having a first end portion 22, a second wing portion 30 having a second end portion 32, a third wing portion 40 having a third end portion 42, and a fourth wing portion 50 having a fourth end portion 52. Each of the end portions 22, 32, 42 and 52 have a planar surface, and as will be described, each include different designs in order to produce a different tone or sound in application. In particular, the end portion 22 of wing portion 20 preferably is of design of a traditional guitar pick. In particular, the wing portion 20 includes a single plucking end 25 and has a substantially conical shape. Preferably, end portion 32 of wing portion 30 includes a plucking end 35 which uses a jagged or serrated edge defining a pair of peaks 37 and a valley 38 therebetween so that as a note is struck with plucking end 35, the pair of peaks 37 strike the string in rapid sequence. Preferably, end portion 42 of wing portion 40 includes a plucking end 45 which uses a jagged or serrated edge defining three peaks 47 and a pair of valleys 48 therebetween so that as a note is struck with plucking end 45, the three peaks 47 strike the string in rapid sequence. Preferably, end portion 52 of wing portion 50 includes a plucking end 55 which uses a jagged or serrated edge defining four peaks 57 and three valleys 58 therebetween so that as a note is struck with plucking end 55, the four peaks 57 strike the string in rapid sequence.

The spacing between the pair of peaks 37 is of a sufficient distance to give a percussive sound during a single stroke in a single direction applying wing portion 30. Further, the peak to peak spacing is preferably uniform. The spacing between the three peaks 47 is of a sufficient distance to give a percussive sound during a single stroke in a single direction applying wing portion 40. Further, the peak to peak spacing is preferably uniform. Likewise, the spacing between the four peaks 57 is of a sufficient distance to give a percussive sound during a single stroke in a single direction applying wing portion 50. Further, the peak to peak spacing is preferably uniform.

The jagged or serrated edge described above can be achieved in any suitable fashion. Preferably, the picks having the multiple wing portions can be made of metal or molded of a plastic material and the serrated surface formed during the manufacturing process.

In the preferred embodiment, and as illustrated in FIG. 2, the plucking end 35, having the pair of peaks is angularly designed such that each peak member is angularly disposed to its adjacent peak member. That is, the first peak member designated 37A having a length "L" is slightly greater than the subsequent peak member designated as 37B. This gives a depth as between the multiple peaks members that is appropriate so that each of the peaks defined on the plucking end individually strikes the string in rapid sequence with the first peak 37A striking the string first. This angular design as just described of plucking end 35 is also incorporated with ends 45 and 55 so that multiple peaks of each respective end 45, 55 individually strikes the string in rapid sequence.

Because the end 22 of the first wing portion 20 is not serrated, the pick 10 may be used to obtain a conventional sound by application of the first wing portion 20. By application of the wing portions 30, 40 and 50 of the pick 10, a guitar player can achieve the effect of picking the same note very fast, and achieving a maximum percussive effect as the selected multiple peaks of wing portions 30, 40 or 50 respectively strike the string.

Figure 3:
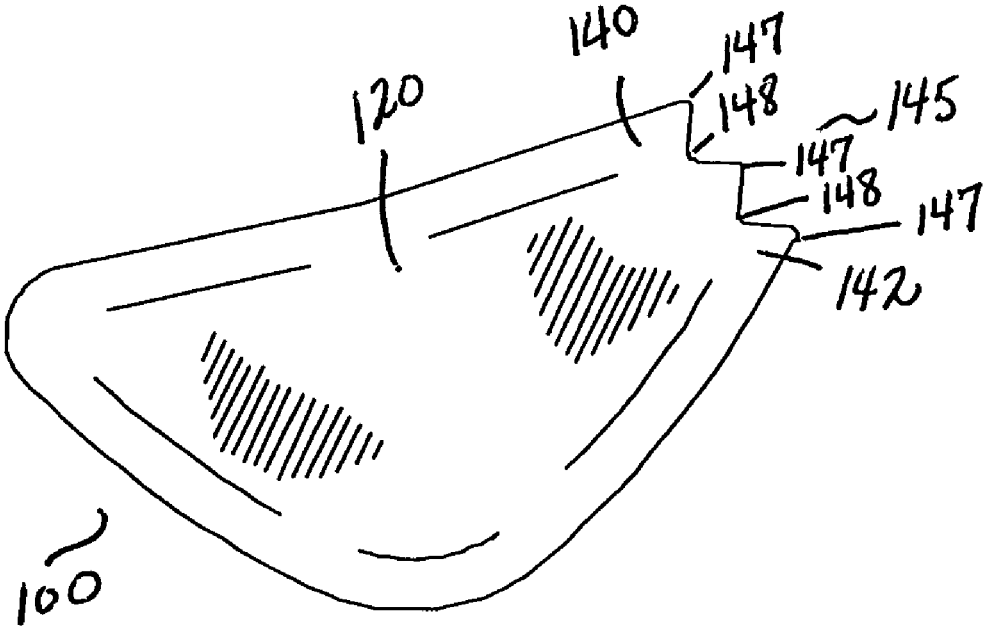
FIG. 3 is an alternate top plan view of the improved guitar pick of the present invention.

Although the description above contains many specificities, these should not be construed as limiting the scope of the invention but as merely providing illustrations of some of the presently preferred embodiments of this invention. For example, while the discussion herein describes the improved guitar pick 10 as including four wing portions 20, 30, 40 and 50, it should be understood that the pick 10 of the present invention can include at least one and up to four wing portions as discussed above. Referring to FIG. 3 represents an alternate embodiment of the present invention. A pick 100 having a substantially planer central gripping portion 120 and having only a single wing portion 140 is shown. The wing portion 140 having an end portion 142. The end portion 142 having a planer surface, and includes a plucking end 145 which uses a jagged or serrated edge defining three peaks 147 and a pair of valleys 148 therebetween so that as a note is struck with plucking end 145, the three peaks 147 strike the string in rapid sequence. The spacing between the three peaks 147 is of a sufficient distance to give a percussive sound during a single stroke in a single direction applying wing portion 140. Likewise, a pick according to the present invention may include only two wing portions (not shown) for example, having a first wing portion having a plucking end like that of plucking end 35 and having a second wing portion having a plucking end like that of plucking end 45. Any variation of number of wing portions and defined plucking ends can be included according to the embodiments described above.

It would be obvious to those skilled in the art that modifications may be made to the embodiments described above without departing from the scope of the present invention.

Thus the scope of the invention should be determined by the appended claims in the formal application and their legal equivalents, rather than by the examples given

I claim:

1. A plectrum for use with stringed instruments, said plectrum comprising:

a central gripping portion, first, second, third and fourth wing portions extending one each in a respective different longitudinal direction about a periphery of said gripping portion, wherein said wing portions are equally spaced relative to each adjacent wing portion, wherein said first wing portion having a first end that defines a first plucking end having a conical shape adapted for strumming or plucking the strings of a stringed instrument, wherein said second wing portion having a second plucking end that defines a pair of equally spaced peak members, said second plucking end adapted so that each of said pair of peak members strike the string in rapid sequence, wherein said third wing portion having a third plucking end that defines three equally spaced peak members, said third plucking end adapted so that each of said three peak members strike the string in rapid sequence, wherein said fourth wing portion having a fourth plucking end that defines four equally spaced peak members, said fourth plucking end adapted so that each of said four peak members strike the string in rapid sequence, wherein said central gripping portion and said first, second, third, and fourth wing portion define a coplanar surface.

2. The plectrum as recited in claim 1, wherein said gripping portion and said first, second, third, and fourth wing portions having the same thickness.

3. The plectrum as recited in claim 1, wherein each of said peak members of each of said second, third and fourth wing portions are separated by valleys.

4. The plectrum as recited in claim 1, wherein each peak member of each of said second, third and fourth wing portions respectively, is angularly disposed relative to its adjacent peak member.

* * * * *